US011806883B2

(12) United States Patent
Frati et al.

(10) Patent No.: US 11,806,883 B2
(45) Date of Patent: Nov. 7, 2023

(54) FOLDING KNIFE

(71) Applicant: ORESTE FRATI S.R.L., Maniago (IT)

(72) Inventors: Gabriele Frati, Maniago (IT); Denis Simonutti, Cavasso Nuovo (IT)

(73) Assignee: ORESTE FRATI S.R.L., Maniago (IT)

( * ) Notice: Subject to any disclaimer, the term of this patent is extended or adjusted under 35 U.S.C. 154(b) by 95 days.

(21) Appl. No.: 17/614,456

(22) PCT Filed: Apr. 29, 2020

(86) PCT No.: PCT/IB2020/054038
§ 371 (c)(1),
(2) Date: Nov. 26, 2021

(87) PCT Pub. No.: WO2020/240306
PCT Pub. Date: Dec. 3, 2020

(65) Prior Publication Data

US 2022/0305681 A1 Sep. 29, 2022

(30) Foreign Application Priority Data

May 31, 2019 (IT) ..... 102019000007731

(51) Int. Cl.
*B26B 1/04* (2006.01)

(52) U.S. Cl.
CPC ..... *B26B 1/046* (2013.01)

(58) Field of Classification Search
CPC ..... B26B 1/046; B26B 1/02; B26B 1/048; B26B 1/044
USPC ..... 30/159, 155, 156, 158, 160, 161
See application file for complete search history.

(56) References Cited

U.S. PATENT DOCUMENTS 3,702,501 A * 11/1972 Wood ..... B26B 1/046 D8/99
6,158,127 A * 12/2000 Taylor ..... B26B 1/02 30/158
6,360,443 B1 3/2002 Remus
7,325,312 B1 * 2/2008 Janich ..... B26B 29/02 30/155
10,981,283 B1 * 4/2021 Beets ..... B26B 1/046
(Continued)

OTHER PUBLICATIONS

Sep. 30, 2020 Search Report issued in International Patent Application No. PCT/IB2020/054038.
(Continued)

*Primary Examiner* — Ghassem Alie
(74) *Attorney, Agent, or Firm* — Oliff PLC

(57) ABSTRACT

A folding knife that includes a handle rotatably coupled to a blade through a connecting portion of the latter; the blade being adapted to rotate about a rotation axis with respect to the handle between at least a first position, in which it is extracted from the handle, and a second position, in which it is at least partially housed in the handle. Specifically, the folding knife includes a slider element associated with the blade through a connecting element so as to actuate the rotation of the blade, and the handle includes a guide slit formed facing the connecting portion having a shape of an arc of circumference concentric to the rotation axis, wherein the guide slit is adapted to be slidably engaged by the slider element so as to actuate the rotation of the blade between the first position and the second position.

7 Claims, 3 Drawing Sheets

(56) References Cited

U.S. PATENT DOCUMENTS

| | | | | |
|---|---|---|---|---|
| 2004/0020057 | A1* | 2/2004 | Hughes | B26B 1/046 30/155 |
| 2005/0283982 | A1* | 12/2005 | Menter | B25G 1/08 30/153 |
| 2009/0293286 | A1 | 12/2009 | Williams | |
| 2011/0067246 | A1 | 3/2011 | Perez | |
| 2016/0288344 | A1* | 10/2016 | Squiers | B26B 5/003 |
| 2017/0120461 | A1 | 5/2017 | Tom et al. | |

OTHER PUBLICATIONS

Sep. 30, 2020 Written Opinion issued in International Patent Application No. PCT/IB2020/054038.

* cited by examiner

FOLDING KNIFE

TECHNICAL FIELD

The present invention regards a folding knife which safely and reliably allows to extract and insert the blade into the handle by means of an opening mechanism which is actuated with one hand.

BACKGROUND ART

Known in the state of the art are folding knives which allow to extract and insert the blade into the handle by means of suitable opening mechanisms. Such folding knives are widely used by sportsmen, outdoor activity enthusiasts, hunters, carpenters, and the like due to their portability, safety and practicality when they are in the folded state, i.e. when they are in the closed state, in which the blade is at least partially housed inside the handle. When using them, folding knives are opened by extracting the blade from the handle.

Conventional folding knives typically include automatic-opening knives, i.e. "snap-on" knives, and manual-opening knives.

Automatic-opening folding knives provide for automatic blade extraction mechanisms which are actuated by means of a button provided for on the handle. Upon extracting the blade, one has to touch it with the fingers to manually reinsert it into the handle.

In this state, there is the likelihood of the user hurting him/herself during the step of inserting the blade into the handle, i.e. during the step of folding the folding knife. This drawback is likely to occur especially if a relatively high force is required to overcome a retaining force of locking mechanisms that stably lock the blade in the extracted position.

Furthermore, the automatic extraction of the blade can be dangerous for the user given that the latter does not have a full control of the blade during this movement step. This drawback is likely to occur especially when the user is not familiar with an opening mechanism which is, possibly, not intuitive.

Lastly, the opening mechanism, typically provided for inside the handle, comprises a large number of elements, suitably arranged and connected to each other, which increase the constructive complexity of the folding knife. Thus, during the design step, there arises the need to provide suitable spaces for housing the elements of the opening mechanism in the handle. In this state, the possibilities of the handle conformation are limited, consequently reducing the ergonomics of the folding knife.

Some types of manual-opening folding knives instead provide for a blade having a projection, such as for example a tab, which extends exposed from the handle when the folding knife is in the folded state, i.e. when it is closed. In order to extract the blade, the user initially pushes or applies force with a finger on the projection to extract a portion of the blade and subsequently completes the extraction thereof using both hands, for example by means of a relative rotation of the blade with respect to the handle to which it is rotatably connected.

However, the user could likely accidentally hurt him/herself during the extraction step and during the step of inserting the blade into the handle. This drawback is likely to occur especially if a relatively high force is required to overcome a retaining force of locking mechanisms that stably lock the blade in the extracted or folded position.

Furthermore, the blade is extracted from the handle using both hands and is therefore uncomfortable, difficult to perform and/or poorly intuitive.

Other types of manual-opening folding knives provide for a blade which is extracted by actuating one or more actuator elements which are adapted to guide and block a blade extraction movement, for example in a slidable manner along the longitudinal extension of the handle. Typically, such actuator elements are arranged in the portion of the handle which, in the use conditions, is gripped with the palm of the user's hand.

Thus, during the design step, there arises the need for providing suitable spaces for housing the actuator elements. In this state, possibilities of configuring the handle, in particular in the portion thereof which is gripped with the palm of the hand are limited, hence reducing the ergonomics of the folding knife.

Furthermore, during the steps of extracting the blade, using the knife and inserting the blade, it is necessary to change the position with which the palm of the hand grips the handle. Therefore, the ease of use of the folding knife is decreased, thus complicating the handling of the knife.

Lastly, other known types of manual-opening folding knives provide for opening mechanisms comprising a large number of elements, suitably arranged and connected to each other, which increase the constructive complexity of the folding knife, making the latter not very sturdy and unreliable.

Thus, there arises the need for providing a folding knife capable of overcoming the drawbacks described above.

SUMMARY OF INVENTION

The object of the present invention is to provide a folding knife which reliably ensures the extraction and insertion of the blade into the handle by means of an opening mechanism. Specifically, the opening mechanism is actuated with one hand in a simple and intuitive manner, without directly touching the blade.

Within the scope described above, an object of the present invention is to provide a folding knife which reliably ensures that the blade is locked in the position extracted from the handle and in the position folded in the handle. In this state, the stability of the folding knife is ensured in the use conditions.

A further object is to provide a folding knife in which the opening mechanism does not interfere with the portion of the handle which is gripped with the palm of the hand, i.e. it does not interfere with the position for gripping the handle with the hand. In this state, wide possibilities of design of the handle conformation and, therefore, a high ergonomics of the folding knife, are ensured.

A further object is to provide a folding knife in which the opening mechanism can be actuated with one hand without changing, in the use conditions, the position of gripping the handle with the hand during the steps for extracting the blade, using the knife and inserting the blade. In this state, the folding knife is simple and intuitive to handle.

A further object is to provide a sturdy folding knife which is simple to design and which provides for a small number of elements. In this state, a low manufacturing cost, high operating reliability and easy maintenance of the folding knife are guaranteed.

A further object is to provide a folding knife in which the opening mechanism is actuated with one hand without directly touching the blade, thus ensuring high safety in the use conditions.

The purpose and the objects outlined above, as well as other objects which will become apparent hereinafter from the description, are achieved by means of a folding knife as defined in claim 1.

BRIEF DESCRIPTION OF THE DRAWINGS

The further characteristics and advantages of the folding knife according to the present invention will become apparent in the following description regarding a preferred embodiment provided purely by way of non-limiting example, with reference to the following figures, wherein.

DETAILED DESCRIPTION OF THE INVENTION

In the following description, terms such as "above", "below", "high", "low", "upper", "lower", and the like refer to a folding knife according to the present invention as shown in the attached drawings.

Hereinafter, with reference to FIGS. 1 to 6, described below is a folding knife 10 according to a preferred embodiment of the present invention.

Figure 1:
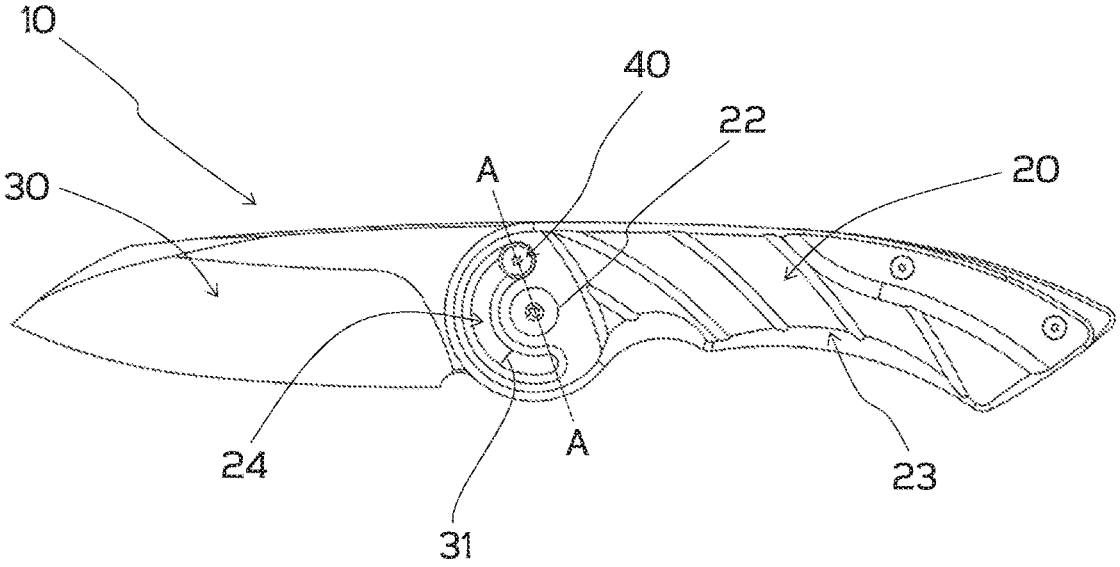
FIG. 1 is a top view of the folding knife, according to a preferred embodiment of the present invention, in which the blade is in a first position extracted from the handle.
Figure 2:
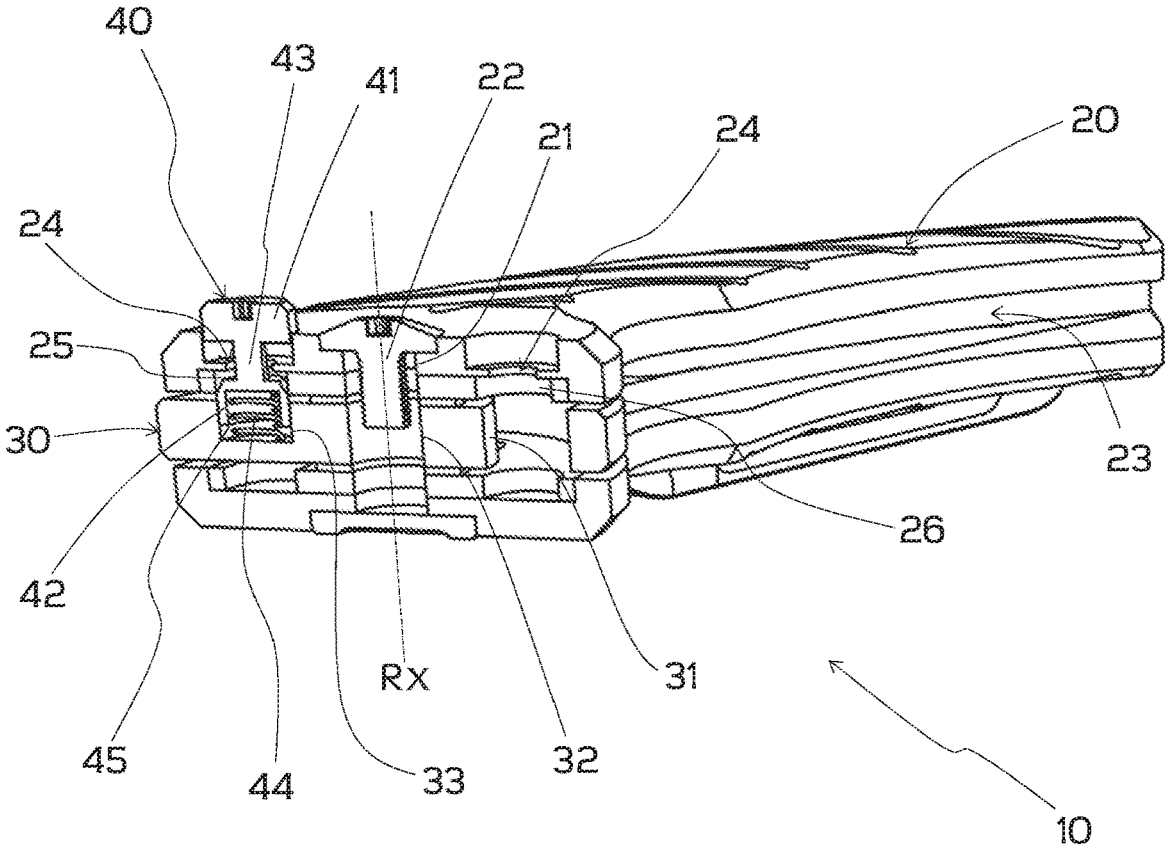
FIG. 2 is a perspective view of the folding knife of FIG. 1 sectioned along the line A-A of FIG. 1.

Referring in particular to FIGS. 1 and 2, the folding knife 10 comprises a handle 20 rotatably coupled to a blade 30 through a connecting portion 31 of the latter.

The connecting portion 31 of the blade 30 corresponds to one of the two end portions of the blade 30 which is coupled to the handle 20 so that the blade 30 is free to rotate with respect to the handle 20 about a rotation axis Rx.

In this embodiment, the connecting portion 31 of the blade 30 and the handle 20 respectively provide for a first circular through hole 32 and a second circular through hole 21 which are arranged coaxially to each other and engaged by a rotation pin 22 with circular cross-section, consisting for example of a screw and a counter-screw cooperating with each other and having a circular cross-section (the figures only show the screw of the rotation pin 22, while the corresponding counter-screw is not shown). The first through hole 32, the second through hole 21 and the rotation pin 22 have a common axis which coincides with the rotation axis Rx. However, this configuration is non-limiting and the connecting portion 31 of the blade 30 can be rotatably coupled to the handle 20 about the rotation axis Rx by means of further coupling means known in the art.

Formed on a lateral edge of the handle 20 is a recess 23 extending substantially perpendicularly to the rotation axis Rx and which is configured to at least partially receive the blade 30.

Figure 3:
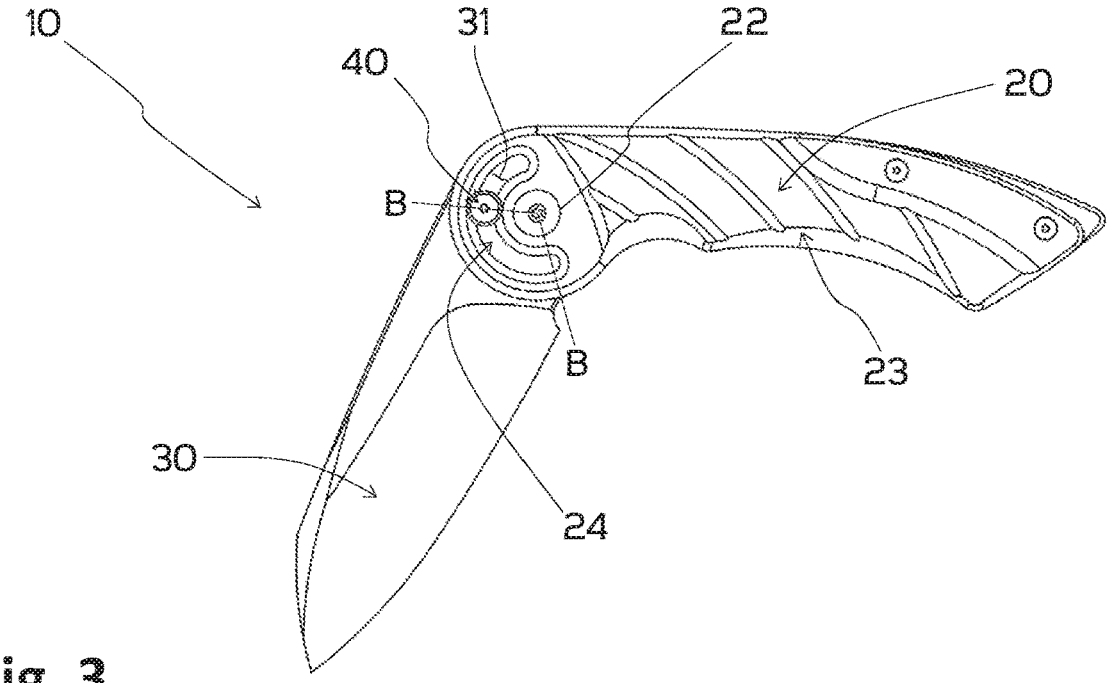
FIG. 3 is a top view of the folding knife of FIG. 1 wherein the blade is in an intermediate position between the first extracted position and a position housed in the handle.
Figure 5:
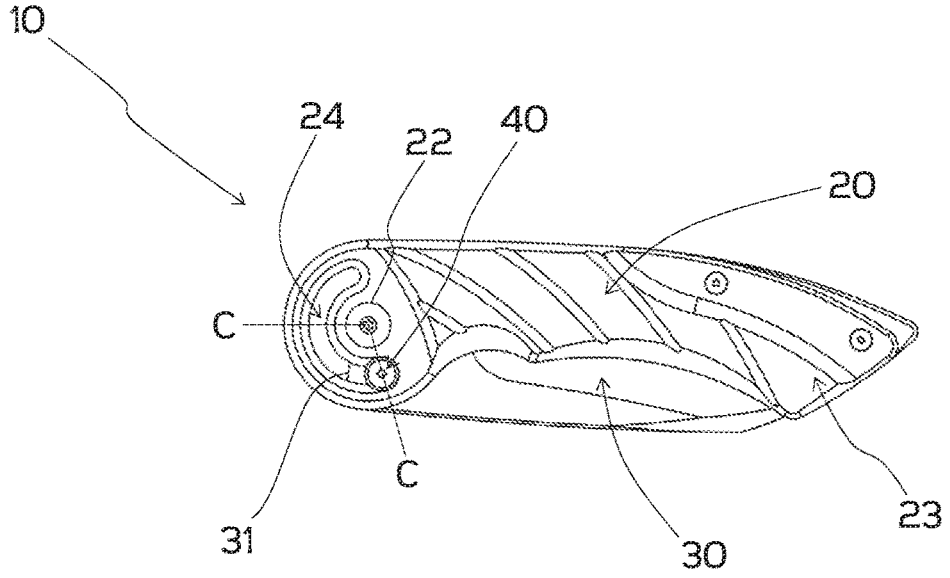
FIG. 5 is a top view of the folding knife of FIG. 1 wherein the blade is in a second position housed in the handle.

Specifically, referring to FIGS. 1, 3 and 5, the blade 30 is adapted to be arranged, rotating with respect to the handle 20 about the rotation axis Rx, in a first position in which it is extracted from the handle 20 (see FIG. 1) and in a second position in which it is at least partially housed in the recess 23 (see FIG. 5) passing through an intermediate position between the first position and the second position (see FIG. 3). In the present invention, the first position of the blade 30 with respect to the handle 20 defines a reversible locked position which is adapted for the use of the folding knife 10, while the second position of the blade 30 with respect to the handle 20 defines a reversible locked position in which the folding blade 10 is in the folded or closed state, in which the cutting edge of the blade 30 is housed in the recess 23 of the handle 20.

Referring again to FIGS. 1 and 2, the folding knife 10 comprises a slider element 40 which is associated with the blade 30 through a connecting element 33 of the connecting portion 31 of the blade 30 so as to actuate the rotation of the blade 30 between the first position and the second position. Specifically, the slider element 40 is associated to the blade 30 through the connecting element 33 so as to be movable along a direction parallel to the rotation axis Rx, remaining associated to the blade 30.

The slider element 40 comprises a control head 41 integral to an engagement body 42 through a stem 43, in which the engagement body 42 is associated with the blade 30 through the connecting element 33.

In this preferred embodiment, the connecting element 33 is a circular blind hole which is formed on the connecting portion 31 of the blade 30. The blind hole 33 is configured to be engaged by the engagement body 42 of the slider element 40 by means of shape coupling. Therefore, in this embodiment, the engagement body 42 has a cylindrical shape wherein an upper base is connected to the stem 43 and the other lower base engages the blind hole 33, substantially abutting against the side walls of the latter. The height of the engagement body 42, i.e. the distance between its bases, is substantially coincident with the depth of the blind hole 33.

Advantageously, since the blind hole 33 is engaged by the engagement body 42 of the slider element 40, when the slider element 40 is rotated about the rotation axis Rx, the rotation of the blade 30 about the rotation axis Rx is actuated. Furthermore, since the slider element 40 is free to rotate about its axis independently of the state of rotation of the blade 30 to which it is associated, an effective control of the slider element 40 is ensured by means of a finger, as explained hereinafter.

The slider element 40 further comprises an elastic presser element 44 which is interposed between the bottom of the blind hole 33 of the blade 30 and the lower base of the engagement body 42 of the slider element 40, and abutting against the latter. The elastic presser element 44 is configured to apply a force which pushes the slider element 40 away from the bottom of the blind hole 33 in a direction parallel to the rotation axis Rx.

In the most preferred embodiment, the engagement body 42 of the slider element 40 comprises an opening 45 formed at the lower base thereof. The opening 45 is adapted to receive the elastic presser element 44, such as a helical compression spring, which is pre-loaded to push the slider element 40 away from the bottom of the blind hole 33 in a direction parallel to the rotation axis Rx. In this state, by forming the opening 45 on the lower base of the engagement body 42, it is advantageously possible to use a helical compression spring with dimensions suitable to apply a desired force on the slider element 40, while simultaneously maintaining the height of the engagement body 42 substantially coincident with the depth of the blind hole 33. Furthermore, in this preferred embodiment, given that the connecting element 33 is a circular blind hole formed on the connecting portion 31 and engaged by the engagement body 42 and the elastic pressing element 44 of the slider element 40, the coupling structure between the blade 30 and the slider element 40 is advantageously compact, specifically along a direction parallel to the rotation axis Rx.

Referring again to FIGS. 1 and 2, the handle 20 of the folding knife 10 comprises a guide slit 24 having a shape of an arc of circumference concentric with the rotation axis Rx. The guide slit 24 is formed on the portion of the handle 20 which corresponds to, or faces, the connecting portion 31 of the blade 30. The guide slit 24 is adapted to be slidably engaged by the slider element 40 so as to guide the rotation of the blade 30 between the first position and the second position.

Specifically, the guide slit 24 of the handle 20 is adapted to be slidably engaged by the stem 43 of the slider element 40. The control head 41 of the slider element 40 projects from the guide slit 24 and it is adapted to be controlled with a finger, as explained below. The engagement body 42 of the slider element 40 is arranged inside the handle 12 and it is associated with the blade 30 through the blind hole 33, i.e. through the connection element 33, as previously mentioned. Furthermore, the engagement body 42 is configured to abut against the walls of the guide slit 24 which are inside the handle 20, so as to prevent the engagement body 42 of the slider element 40 from passing through the guide slit 24.

Furthermore, the handle 20 comprises—in positions aligned with the guide slit 24—a first locking seat 25 and a second locking seat 26 which are substantially recesses formed on the walls of the guide slit 24. The first locking seat 25 and the second locking seat 26 are configured to be alternately engaged by the engagement body 42 of the slider element 40 so as to block the sliding of the latter along the guide slit 24. Specifically, the first locking seat 25 and the second locking seat 26 are formed aligned with the guide slit 24, extending in a direction parallel to the rotation axis Rx, at the positions where the slider element 40 is located when the blade 30 is, respectively, in the first position or in the second position.

In the most preferred embodiment, the first locking seat 25 and the second locking seat 26 are configured to be engaged by the engagement body 42 of the slider element 40 by means of shape coupling, i.e. they have a shape complementary to that of the engagement body 42. Advantageously, in this state, a precise position of the slider element 40 is maintained when the latter reaches, along the guide slot 24, the position corresponding to the first locking seat 25 or to the second locking seat 26, i.e. when it reaches the position in which the blade 30 is in the first position or in the second position.

The elastic presser element 44 of the slider element 40 is configured to apply a force which causes the engagement of the first locking seat 25 or the second locking seat 26 of the handle 20 by means of the engagement body 42 of the slider element 40 when the latter is, respectively, in the position along the guide slit 24 corresponding to the first position or to the second position of the blade 30. Furthermore, the elastic presser element 44 of the slider element 40 is configured so as to disengage the first locking seat 25 or the second locking seat 26 from the slider element 40, or from the engagement body 42 of the latter, when a pressure is applied to the control head 41 by means of a disengagement force which is opposed and which overcomes the force applied by the elastic presser element 44. As explained below, such disengagement force is applied with a finger acting on the control head 41 of the slider element 40.

The slider element 40 is configured so that, when the first locking seat 25 or the second locking seat 26 of the handle 20 are engaged by the engagement body 42, the latter also engages the blind hole 33, i.e. it is also connected to the connecting element 33 of the blade 30. Furthermore, the slider element 40 is configured so that the engagement body 42 continues to engage the blind hole 33 when a pressure is applied to the control head 41 by a disengagement force and the engagement body 42 does not engage either the first locking seat 25 or the second locking seat 26 of the handle 20. In this state, the slider element 40 is always associated to the blade 30 through the connecting element 33 in each sliding position thereof along the guide slit 24.

With reference to FIGS. 1 to 6, described below is the operation of the folding knife 10 according to the preferred embodiment of the present invention.

FIGS. 1 and 2 show the folding knife 10 in the open state in which the blade 30 is in the first position extracted from the handle 20.

Specifically, the elastic presser element 44 of the slider element 40 applies a force along a direction parallel to the rotation axis Rx which causes the engagement of the first locking seat 25 of the handle 20 by means of the engagement body 42 of the slider element 40. Furthermore, the engagement body 42 of the slider element 40 engages the blind hole 33 of the blade 30, i.e. it is connected to the blade 30 through the connecting element 33.

In this state, the blade 30 of the folding knife 10 is locked in the first position by means of the cooperation between the engagement body 42 of the slider element 40 and the first locking seat 25 of the handle 20. Furthermore, the first position of the blade 30 is precisely locked since the engagement body 42 of the slider element 40 engages—by means of shape-coupling—the first locking seat 25 of the handle 20, thus preventing a rotation of the slider element 40 about the rotation axis Rx.

In the use conditions, when the blade 30 is in the first position, the stresses on the latter are typically applied along the longitudinal direction thereof or along a direction perpendicular to the rotation axis Rx. Therefore, it is unlikely for a force be applied to the blade 30 causing a displacement of the engagement body 42 of the slider element 40 along a direction parallel to the axis Rx causing disengagement thereof from the first locking seat 25. Therefore, the locking of the blade 30 in the first position is further ensured.

In order to release the first position of the blade 30, a pressure is applied to the control head 41 of the slider element 40 with the thumb of the hand holding the handle 20. The pressure on the control head 41 to obtain the release is exerted by means of a disengagement force which is opposite and which overcomes the force applied by the elastic presser element 44 on the slider element 40.

Therefore, the first locking seat 25 is released from engagement with the engagement body 42 and the latter maintains engagement with the blind hole 33 of the blade 30, i.e. it remains associated to the blade 30 through the connecting element 33. In this state, by keeping the disengagement force applied to the control head 41, it is possible to slidably guide the slider element 40 along the guide slit 24 by means of the same thumb that applies the disengagement force, as explained below.

Figure 4:
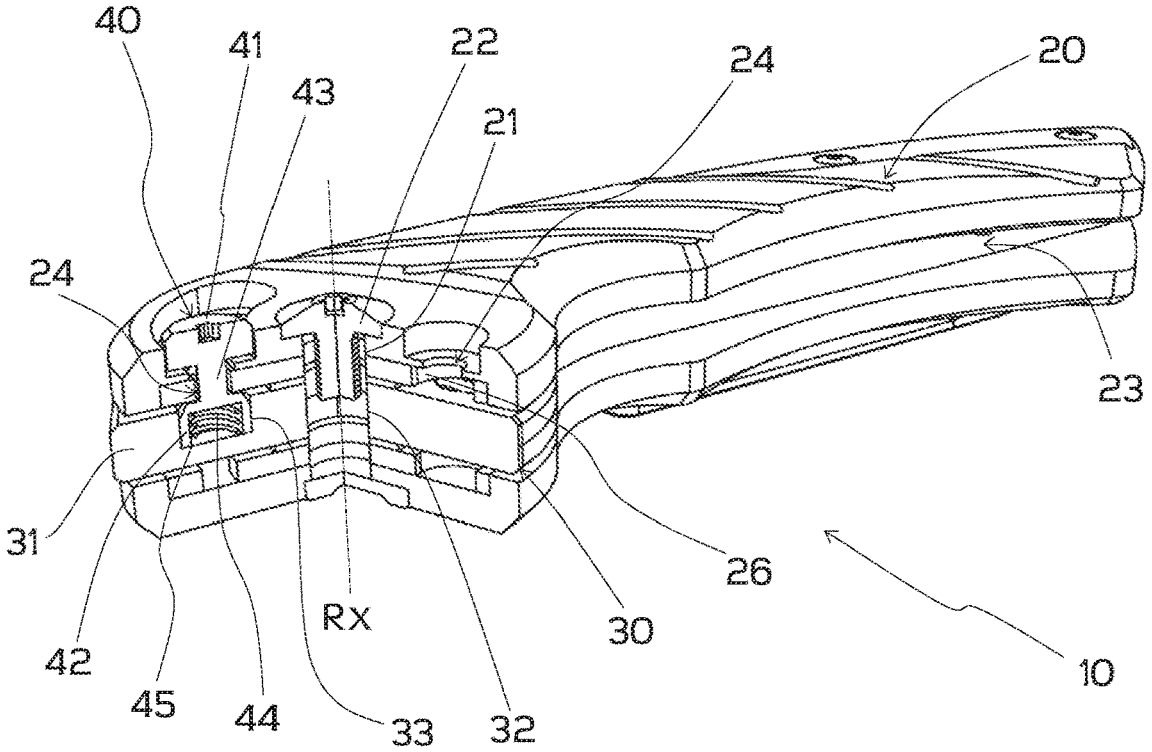
FIG. 4 is a perspective view of the folding knife of FIG. 3 sectioned along the line B-B of FIG. 3.

FIGS. 3 and 4 show the folding knife 10 in an intermediate opening/closing state in which the blade 30 is at an intermediate position between the first position extracted from the handle 20 and the second position in which it is at least partially housed in the recess 23.

Specifically, the disengagement force is applied on the control head 41 of the slider element 40 and the engagement body 42 of the slider element 40 only engages the blind hole 33 of the blade 30, i.e. it is connected to the blade 30 through the connecting element 33.

Thus, without changing the position for gripping the handle 20 with the hand, the slider element 40 is moved with the thumb along the slit 24 toward the second locking seat 26 of the handle 20. Therefore, the blade 30 is rotated about the rotation axis Rx from the first position toward the second position.

In this step, since the slider element 40 is free to rotate about its axis independently of the state of rotation of the blade 30 to which it is associated, an effective control of the slider element 40 is ensured given that the latter does not rotate while the thumb acts thereon. Therefore, a loss of contact between the thumb and the control head 41 of the slider element 40, caused by any relative rotation between the control head 41 and the thumb, is prevented.

It should be observed that, in this step, when the engagement body 42 of the slider element 40 is no longer aligned with the first locking seat 25 of the handle 20, it is possible to move the slider element 40 along the slot 24 using the thumb without applying the disengagement force with the latter. As a matter of fact, in this state the engagement body 42 abuts against the walls of the guide slit 24 and the elastic presser element 44 of the slider element 40 applies a force which generates a friction on the walls of the guide slit 24. Therefore, in this state, it is necessary to apply a force that overcomes the friction force to displace the slider element 40 along the guide slit 24 using the thumb.

Figure 6:
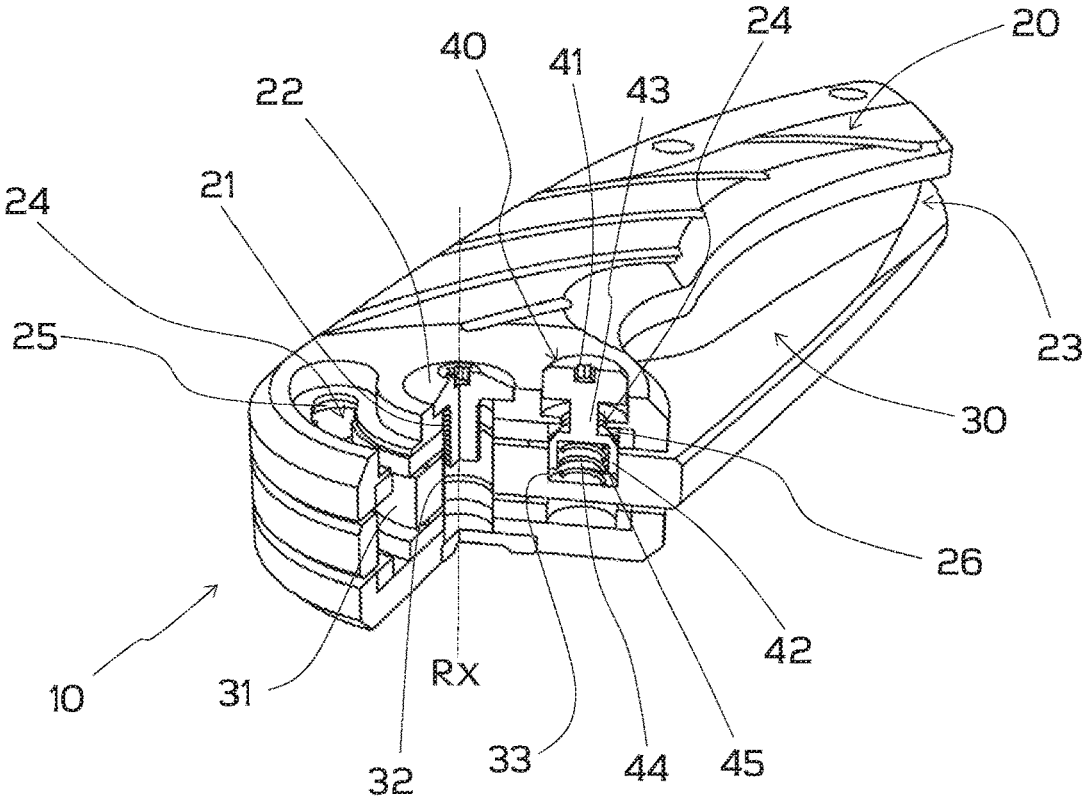
FIG. 6 is a perspective view of the folding knife of FIG. 5 sectioned along the line C-C of FIG. 5.

FIGS. 5 and 6 show the folding knife 10 in a closed state in which the blade 30 is at least partially housed in the recess 23 of the handle 20.

Specifically, when the slider element 40 reaches the position corresponding to the second locking seat 26 along the guide slit 24, unless the disengagement force has already been removed, the user removes the disengagement force applied to the control head 41 of the slider element 40 as explained above with reference to the intermediate opening/closing state of the folding knife 10.

Thus, the elastic presser element 44 of the slider element 40 applies a force along a direction parallel to the rotation axis Rx which causes the engagement of the second locking seat 26 of the handle 20 by means of the engagement body 42 of the slider element 40. Furthermore, the engagement body 42 of the slider element 40 engages the blind hole 33 of the blade 30, i.e. it is connected to the blade 30 through the connecting element 33.

In this state, the blade 30 of the folding knife 10 is locked in the second position by means of the cooperation between the engagement body 42 of the slider element 40 and the second locking seat 26 of the handle 20. Furthermore, the second position of the blade 30 is precisely locked since the engagement body 42 of the slider element 40 engages—by means of shape-coupling—the second locking seat 26 of the handle 20, thus preventing a rotation of the slider element 40 about the rotation axis Rx.

In order to obtain the release of the second position of the blade 30, the same procedure is followed as described above with reference to the step of releasing the first position of the blade 30.

It is clear that it is possible to provide for further embodiments of the folding knife 10, according to the present invention, without departing from the scope claimed.

For example, in the embodiment previously described, the connecting element 33 is a blind hole adapted to be engaged by the engagement body 42 of the slider element 40. However, this embodiment is non-limiting and the element 33 can be formed by a connecting pin, integral to the connecting portion and about which are wound the coils of the elastic presser element 44, which is adapted to engage the opening 45 of the engagement body 42 of the slider element 40. In this state, like in the embodiment described above, the slider element 40 is free to rotate about its axis independently of the state of rotation of the blade 30 to which it is associated. In the preferred embodiment, the connecting element 33 is a blind hole formed on the connecting portion 31 of the blade 30 ensuring compactness of the folding blade 10 along a direction parallel to the rotation axis Rx.

Furthermore, in the embodiment previously described, the slider element 40 is free to rotate on its axis independently of the state of rotation of the connecting portion 31 of the blade 30 to which it is associated. However, it is possible to provide for an embodiment in which the slider element 40 is formed integral to the connecting portion 31 of the blade 30 and it is configured so as to be movable along a direction parallel to the rotation axis Rx.

Furthermore, in the embodiment previously described, the handle 20 comprises a first locking seat 25 and a second locking seat 26 formed at the guide slit 24. However, it is possible to provide for an embodiment in which more than one first locking seat 25, each corresponding to respective first positions of the blade 30, can be provided for. Therefore, it is possible to provide for a locking of the blade 30 in more than one position extracted from the handle 20.

Furthermore, it is possible to provide for a folding knife 10 comprising abutment means, such as for example a pin, configured to act as a mechanical end stop for the rotation of the blade 30 when the latter is in the first position extracted from the handle 20.

Furthermore, it is possible to provide for a folding knife 10 comprising an elastic return element, such as for example a helical spring, which connects the handle 20 to the connecting portion 31 of the blade 30 and which is configured, for example, to oppose the movement of the blade 30 from the first position to the second position. In this state, the elastic return element assists the displacement of the blade 30 from the second position to the first position and biases the sliding of the slider element 40 along the guide slit 24 toward the first locking seat 25.

In the light of the above, it is clear that the folding knife 10 according to the present invention attains the objects and advantages initially envisaged. Specifically, the folding knife 10 reliably ensures the extraction and insertion of the blade 30 into the handle 20 by means of an opening mechanism which is actuated with one hand, without directly touching the blade 30.

Furthermore, the folding knife 10 reliably ensures that the blade 30 is locked in the first extracted position or in the second folded position in the handle 20. Thus, the stability of the folding knife 10 is ensured in the use conditions. Specifically, the locking of the blade 30 in the first position or in the second position is ensured by the cooperation between the engagement body 42 of the slider element 40 and the locking seats, respectively the first 25 and the second 26, of the handle 20.

Furthermore, the guide slit 24 of the handle 20 and the slider element 40 are arranged at the connecting portion 31 of the blade 30 and therefore they do not interfere with the position for gripping the handle 20 with the hand. Thus, wide possibilities of conformation of the handle 20 are guaranteed, with ensuing advantages of ergonomics of the folding knife 10.

Furthermore, the opening/closing of the folding knife 10 can be actuated with one hand without changing the position of the latter during the steps of extracting the blade, using the knife and inserting the blade. Specifically, the guide slit 24 of the handle 20 and the slider element 40 are arranged at the connecting portion 31 of the blade 30 and therefore they can be easily actuated using the thumb of the hand gripping the handle 20 under the normal operative conditions. Therefore, this configuration allows an effective and intuitive control of the slider element 40 by means of the thumb.

Furthermore, in order to release the blade 30 from the first position or from the second position, it is sufficient to apply—with the thumb—a disengagement force on the control head 41 of the slider element 40 which can be adjusted by appropriately choosing the characteristics of the elastic presser element 44.

Lastly, the folding knife 10 is sturdy, easy to design and it provides for a small number of elements. Thus, a low manufacturing cost, high operating reliability and easy maintenance of the folding knife 10 are guaranteed.

Naturally, the materials and equipment used to implement the present invention, as well as the shape and dimensions of the individual components, may be the most suitable depending on the specific requirements.

The invention claimed is:

1. A folding knife comprising:

a blade;

a handle rotatably coupled to the blade through a connecting portion, wherein the blade is adapted to rotate about a rotation axis with respect to the handle between at least a first position where the blade is extracted from the handle, and a second position where the blade is at least partially housed in the handle; and a slider element associated to the blade through a connecting element so as to actuate the rotation of the blade, wherein:

the handle comprises a guide slit formed facing the connecting portion of the blade, the guide slit has a shape of an arc of circumference concentric to the rotation axis, and also adapted to be slidably engaged by the slider element so as to actuate the rotation of the blade between the first position and the second position, the handle also comprises along the guide slit a first locking seat and a second locking seat configured to be alternately engaged by the slider element when the blade is respectively in the first position or in the second position, the slider element comprises a body and an elastic presser element engaged with the body, the elastic presser element being configured to apply a force which causes the engagement of the locking seats by means of the slider element, and further configured to disengage the locking seats from the slider element by applying on the slider element a pressure which overcomes the force applied by the elastic presser element so as to move the body and the elastic presser element of the slider element along the guide slit to actuate the rotation of the blade, the slider element is associated to the blade so as to be movable along a direction parallel to the rotation axis, and the elastic presser element applying a force along a direction parallel to the rotation axis.

2. The folding knife according to claim 1, wherein the connecting element is formed integral to the connecting portion of the blade, and the slider element is directly associated to the connecting element so as to be pivotable with respect to the connecting element.

3. The folding knife according to claim 1, wherein the body of the slider element comprises a control head integral with an engagement body through a stem, wherein the control head projects from the guide slit, the stem slidably engages the guide slit and the engagement body is associated to the blade through the connecting element.

4. The folding knife according to claim 3, wherein the first locking seat and the second locking seat are configured to be engaged by the engagement body of the slider element.

5. The folding knife according to claim 3, wherein the connecting element is a circular blind hole which is formed on the connecting portion of the blade and which is also configured to be engaged by the engagement body of the slider element, the engagement body having a cylindrical shape wherein a base is integral with the control head through the stem and the other base engages the blind hole.

6. The folding knife according to claim 3, wherein the slider element is configured so that the engagement body simultaneously engages the connecting element and alternatively the first locking seat or the second locking seat when the blade is respectively in the first position or in the second position.

7. The folding knife according to claim 3, wherein the engagement body of the slider element comprises an opening adapted to receive the elastic presser element.

* * * * *